United States Patent [19]

Yoshida et al.

[11] 4,442,323

[45] Apr. 10, 1984

[54] MICROPHONE WITH VIBRATION CANCELLATION

[75] Inventors: Satoshi Yoshida; Hidejiro Higashi, both of Saitama, Japan

[73] Assignee: Pioneer Electronic Corporation, Tokyo, Japan

[21] Appl. No.: 284,023

[22] Filed: Jul. 17, 1981

[30] Foreign Application Priority Data

Jul. 19, 1980 [JP] Japan ..... 55-102295

[51] Int. Cl.[3] ..... H04R 1/02

[52] U.S. Cl. ..... 179/110 A; 381/94; 381/95; 179/111 E

[58] Field of Search ..... 179/1 P, 1 E, 111 E, 179/110 B, 1 VC, 121 D, 1 F, 115 DV, 1 DM; 367/170; 369/107; 360/137

[56] References Cited

U.S. PATENT DOCUMENTS

| | | | |
|---|---|---|---|
| 3,025,359 | 3/1962 | Schilling et al. | 179/110 A |
| 3,405,288 | 10/1968 | Dittrich | 179/110 A |
| 3,941,932 | 3/1976 | D'Hoogh | 179/1 F |
| 4,066,842 | 1/1978 | Allen | 179/1 P |
| 4,131,760 | 12/1978 | Christensen et al. | 179/1 P |
| 4,272,846 | 6/1981 | Muratani et al. | 455/296 |
| 4,297,531 | 10/1981 | Dalhof et al. | 179/1 P |

FOREIGN PATENT DOCUMENTS

| | | | |
|---|---|---|---|
| 2640324 | 3/1978 | Fed. Rep. of Germany | 179/1 P |
| 55-44207 | 3/1980 | Japan | 179/111 E |

*Primary Examiner*—G. Z. Rubinson
*Assistant Examiner*—Robert Lev
*Attorney, Agent, or Firm*—Sughrue, Mion, Zinn, Macpeak & Seas

[57] ABSTRACT

A microphone unit particularly adapted to be used as a built-in microphone for a device such as a tape recorder in which vibration-induced components in the output of the microphone are substantially eliminated. An electret-type microphone element is mounted in a cylindrical-shaped microphone case having a central wall. A ceramic piezoelectric element is secured against the wall with a weight pressing against the opposite side of the piezoelectric element. The outputs of the microphone element and the piezoelectric vibration pickup unit are combined in a circuit in which the characteristics of the output of the piezoelectric element are corrected so that substantially all of the vibration-induced component from the microphone element is cancelled.

9 Claims, 10 Drawing Figures

FIG. 6A FIG. 6B
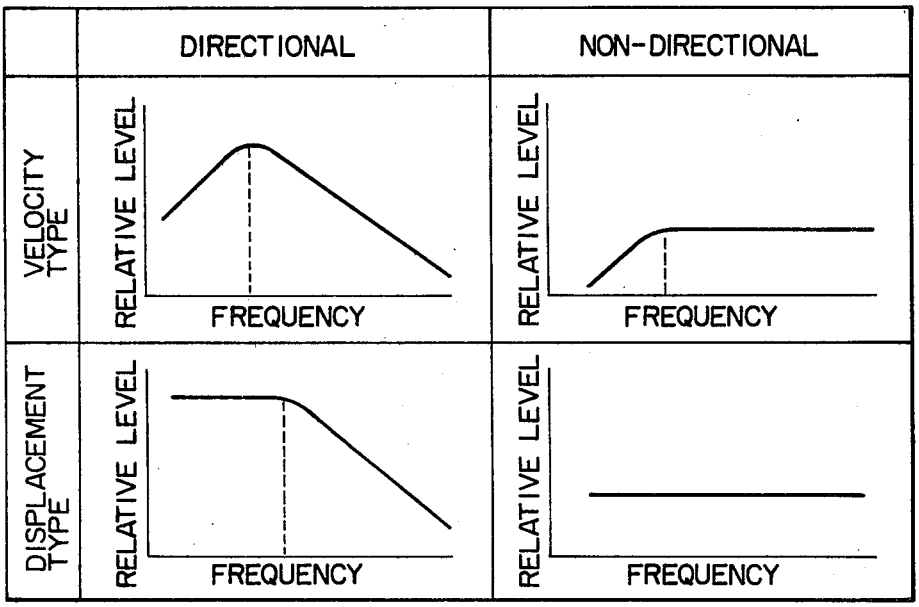
FIG. 6C FIG. 6D
FIG. 7
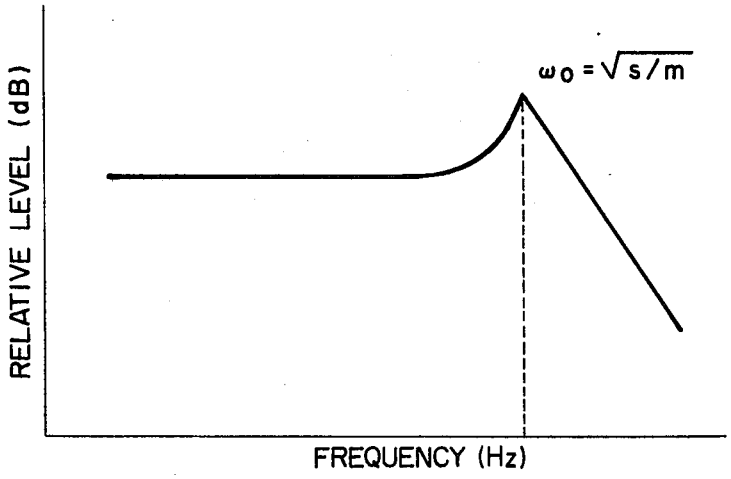

MICROPHONE WITH VIBRATION CANCELLATION

BACKGROUND OF THE INVENTION

The present invention relates to a microphone, more particularly, to a microphone adapted to be internally mounted on a tape recorder or the like.

In a tape recorder, there are included many structural components which generate vibrations, such as motors, gears, pulleys, etc. Accordingly, in a tape recorder having a built-in microphone, vibrations generated in the aforementioned structural components are transmitted to the case of the microphone and the vibrations converted to noise by the microphone. The noise signal produced in response to vibration is mixed in the output signal of the microphone.

In order to avoid this, in a prior art arrangement, the microphone is mounted on the tape recorder body through an elastic material such as rubber. However, for example, since an electret microphone has a small weight, a sufficient damping effect cannot be attained.

SUMMARY OF THE INVENTION

In view of the above-noted defects, an object of the present invention is to provide a microphone construction for a tape recorder or the like in which noise caused by vibrations transmitted to the microphone case is eliminated.

In accordance with this and other objects, the present invention provides a microphone for a tape recorder or the like including an electret microphone unit for collecting sound and a piezoelectric type vibration pickup unit for detecting vibration transmitted to a microphone case. The electret microphone unit and the piezoelectric type vibration pickup unit are commonly mounted in the microphone case. The signal produced by the vibration pickup unit is combined with the output signal of the electret microphone in opposite phase to thereby remove noise components produced by vibrations.

BRIEF DESCRIPTION OF THE DRAWINGS

FIGS. 6A–6D are graphs of vibration characteristics of various capacitance type microphone, FIG. 6A showing a characteristic of a directional velocity type microphone, FIG. 6B showing a characterisic of non-directional velocity type microphone, FIG. 6C showing a characteristic of a directional displacement type microphone, and FIG. 6D showing a characteristic of a non-directional type microphone; and FIG. 7 is a graph of a vibration characteristic of a piezoelectric type vibration pickup unit.

DESCRIPTION OF THE PREFERRED EMBODIMENTS

The present invention will now be described with reference to the accompanying drawings.

Figure 1:
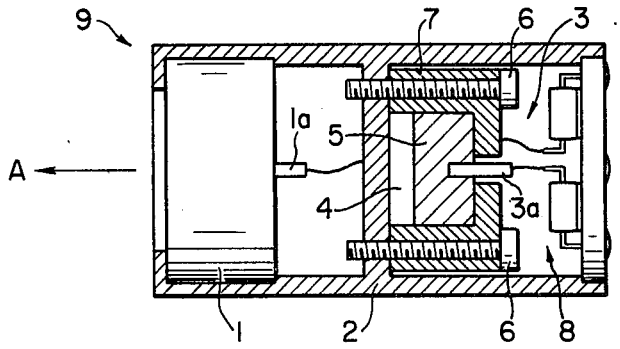
FIG. 1 is a cross-sectional view of a preferred embodiment of a microphone of the present invention.

FIG. 1 is a cross-sectional view of an example of a microphone constructed according to the present invention. Reference numeral 1 designates an electret microphone unit mounted in a case 2. In addition, a piezoelectric type vibration pickup unit 3 is also mounted in the case 2 for sensing vibration transmitted to the case 2. The vibration pickup unit 3 is preferably a ceramic piezoelectric element 4 one side surface of which is in intimate contact with the case 2 and a weight 5 which is in contact with the other side surface of the piezoelectric element 4. Both the ceramic piezoelectric element 4 and weight 5 are mounted in a cup-shaped case 7 fixed to the case 2 by screws 6. The sensing direction of the vibration pickup unit 3 corresponds to a primary axial direction indicated by an arrow A in FIG. 1 since the vibration pickup unit 3 has a high sensitivity with respect to vibration transmitted in a primary axial direction.

Figure 2:
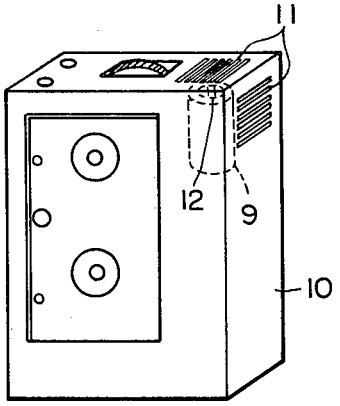
FIG. 2 is a perspective view of a tape recorder in which the microphone of the invention is mounted.

The respective output signals of the electret microphone unit 1 and the vibration pickup unit 3 are supplied through output terminals 1*a* and 3*a* to a circuit 8 for impedance conversion and characteristic correction. The microphone 9 thus constructed is mounted, for example, in a tape recorder 10 as shown in FIG. 2. In FIG. 2, reference numeral 11 denotes sound introduction guide slits formed in the tape recorder body and reference numeral 12 denoted sound introduction guide slits formed in the case 2 of the microphone 9.

Figure 3:
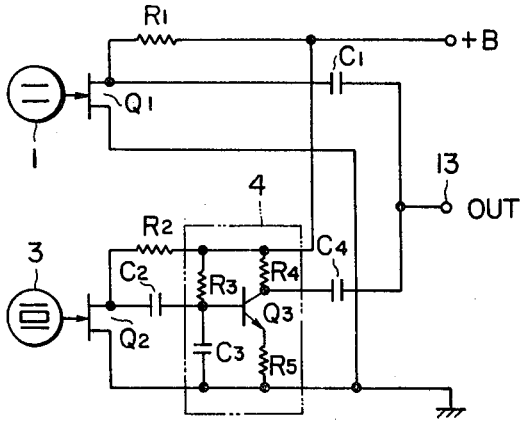
FIG. 3 is a detailed circuit diagram of a circuit used with the microphone shown in FIG. 1.

FIG. 3 is a circuit diagram of an example of the circuit 8 shown in FIG. 1. In the figure, an output signal of the electret microphone unit 1 is supplied to the gate of an FET (Field Effect Transistor) $Q_1$ for impedance conversion. The source of the FET $Q_1$ grounded and the drain thereof is connected to a voltage source +B through a resistor $R_1$ and also to an output terminal 13 through a capacitance $C_1$ provided for direct current blocking. The output signal of the vibration pickup unit 3 is supplied to the gate of an FET $Q_2$. The source of the FET $Q_2$ is grounded and the drain thereof is connected to the voltage source +B through a resistor $R_2$ and also to an input terminal of a characteristic correction circuit 14 through a capacitor $C_2$ for direct current cutoff. The characteristic correction circuit 14 is composed of a transistor $Q_3$, a capacitor $C_3$ and resistors $R_3$ to $R_5$ as shown in FIG. 3. The characteristic correction circuit 14 makes the sensitivity (vibration characteristic) and frequency response of the vibration pickup unit 3 equal to the sensitivity and frequency response of the electret microphone unit 1 with respect to the vibration sensed by the microphone unit 1. A signal opposite in phase to the input signal is outputted. The output signal of the characteristic correction circuit 14 is added to the output signal of the electret microphone unit 1 through a direct current blocking capacitor $C_4$.

The vibration characteristic of a directional capacitance type microphone vibrated at a constant rate is constant up to a lower limit frequency $f_l$ dropping off beyond this value at approximately 6 dB/octave. In case of a non-directional microphone, the stiffness of the vibrating diaphragm varies according to the setting of a control device, and the mechanical impedance thereof is high. Therefore, the non-directional microphone has a low vibration sensitivity in comparison with a directional microphone and the frequency response of the non-directional microphone is constant to an upper limit frequency $f_h$. On the other hand, the vibration characteristics of the vibration pickup unit 3 are constant up to a resonance frequency $f_o$ $$\left(f_o = \frac{1}{2\pi}\sqrt{\frac{s}{m}}\right)$$

which is defined by the mass m of the weight 5 and the stiffness s of the ceramic piezoelectric element 4. Therefore, in consideration of the audio frequency range that the microphone is intended for, only sensitivity correction may be required for the correction circuit 14 in case where the microphone 9 is of the non-directional type whereas both sensitivity and frequency correction are required in the case where the microphone 9 is of the directional type.

Figure 4:
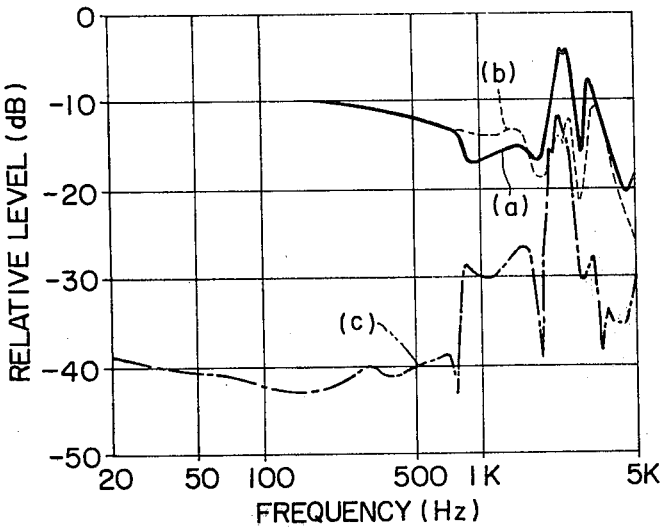
FIG. 4 is a graph showing a frequency response characteristic of a directional microphone vibrated at a constant acceleration speed.

FIG. 4 is a graph showing a frequency response characteristic in which a directional microphone used as the the electret microphone unit 1 is vibrated at a constant rate in the primary axial direction by an oscillator (not shown). In the figure, the solid line (a) denotes the output of the electret microphone unit 1 after impedance conversion, a dotted line (b) the output of the vibration pickup unit 3 after characteristic correction, and a dot and chain line (c) the output of the microphone 9 after combining the above-described two outputs in opposite phase.

Figure 5:
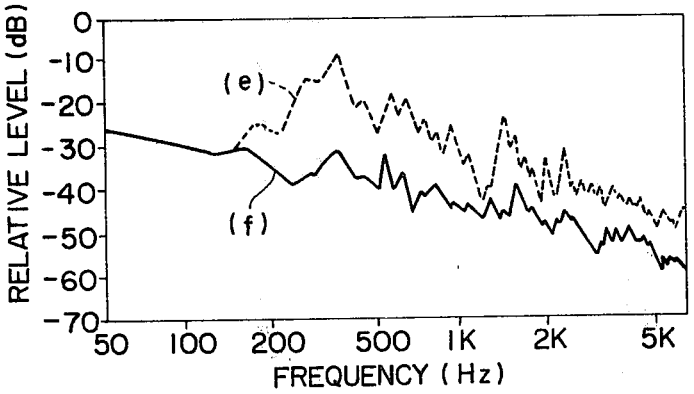
FIG. 5 is a graph showing noise vectors for the case where the microphone of the invention is applied to a tape recorder.

FIG. 5 is a graph showing noise vectors of the microphone output of a microphone mounted in a tape recorder in accordance with the invention. In the figure, a dotted line (e) designates noise outputted by a directional electret microphone and a solid line (f) designates noise outputted by a directional microphone of the present invention equipped with the pickup unit 3. As is apparent from the graph, with the invention it is possible to remove noise caused by vibration generated in the interior of the tape recorder.

FIGS. 6A–6D are vibration characteristics of various capacitance type microphones. Since a directional capacitance type microphone is a displacement type microphone, a vibration characteristic of a cancellation unit (pickup unit) thereof can be readily adjusted. If a capacitance type microphone is used as a cancellation unit, the unit must be shut off from the outside in order to prevent an output therefrom due to sound waves. Namely, the cancellation microphone has a characteristic as shown in FIG. 6D. A directional capacitance type microphone has a characteristic as shown in FIG. 6C. The sensitivity difference thereof in middle and low frequency ranges is 15 dB or more. In order to correct this, it is required to increase the amplification factor of the cancellation unit or to decrease the amplitude of the output of the electret microphone unit. In the former case, in view of the stability of the unit, it is impossible to unduly increase the amplification factor, whereas in the latter case, an increase in the amplitude leads to an inferior S/N ratio.

A vibration characteristic curve of a piezoelectric type vibration pickup unit is shown in FIG. 7. The characteristic curve remains constant below a resonant frequency $\omega_o = \sqrt{s/m}$, which is determined by the stiffness s of the piezoelectric element and the m of a counterweight. Therefore, it is easy to simulate to the characteristic shown in FIG. 6C with an appropriately constructed low-pass filter. To do this, the cutoff frequency $f_c$ of the low-pass filter is set at a lower limit (−3 dB from the midpoint) of the frequency response for sound waves of the directional capacitance type microphone. The sensitivity can then be suitably selected according to constants of the piezoelectric element and the mass m.

As described above in detail, according to the present invention, noise produced by vibration transmitted to the microphone case is positively eliminated, thereby resulting in an enhanced S/N ratio.

The vibration which can be eliminated by the use of the present invention includes not only internal vibration caused by the motor of the tape recorder or the like but also external vibration transmitted to the tape recorder via a desk upon which the tape recorder is positioned or the like. For an internal microphone, a non-directional microphone is usually used which has a low sensitivity to vibration. However, the present invention is particularly effective for a directional microphone having a high vibration sensitivity.

The present invention has been described with reference to a tape recorder although the invention is not limited to such a use. The present invention is also applicable to microphones mounted internally in film or video cameras and the like.

What is claimed is:

1. A microphone unit with vibration cancellation comprising: a microphone case; a capacitance type microphone element fixed to said case; a piezoelectric type vibration pickup unit fixed to said case; an inertial body, said vibration pickup unit being disposed between said inertial body and said case, a ratio of a stiffness of said vibration pickup unit to a mass of said inertial body being such that a vibration frequency response of said vibration pickup unit and said microphone are similar; and circuit means for combining outputs of said microphone element and said vibration pickup unit wherein a vibration component in said output of said microphone unit is cancelled by said output of said vibration pickup unit.

2. The microphone unit of claim 1 wherein said vibration pickup unit has a sensitive axis parallel to a vibration-sensitive axis of said microphone element.

3. The microphone unit of claim 2 wherein said vibration pickup unit comprises a piezoelectric element and wherein said microphone element comprises a directional electret microphone element.

4. The microphone unit of claim 1 further comprising a weight secured to said case with at least one side of said vibration pickup unit abutting said weight.

5. The microphone unit of claim 4 wherein said case comprises a generally cylindrically-shaped outer body and a central wall within said cylindrical body extending perpendicular to a longitudinal axis of said body, said microphone element being fixed at one end of said body and said vibration pickup unit being secured to said wall.

6. The microphone unit of claim 5 further comprising a weight secured against a surface of said vibration pickup unit on a side thereof opposite said wall.

7. The microphone unit of claim 6 further comprising a bracket and screws for securing said weight against said vibration pickup unit.

8. The microphone unit of any of claims 1–7 wherein said circuit means comprises a first FET transistor having an input coupled to an output of said microphone element; a second FET transistor having an input coupled to an output of said vibration pickup unit; and a characteristic correction circuit having an input coupled to an output of said first FET transistor, an output of said characteristic correction circuit being coupled to an output of said first FET transistor, wherein a vibration component contained in said output of said FET transistor is cancelled while a sound wave component from said output of said first FET transistor is passed to an output terminal.

9. The microphone unit of any of claims 1–7 wherein said circuit means comprises an FET first transistor having a gate coupled to receive said output of said microphone element and a source coupled to ground; a first resistor coupled between a drain of said first transistor and a positive voltage source; a first capacitor coupled between said drain of said first transistor and an output terminal; an FET second transistor having a gate coupled to receive said output of said vibration pickup unit and a source coupled to ground; a second resistor coupled between a drain of said second transistor and said positive voltage source; a bipolar NPN third transistor; a third resistor coupled between said positive voltage source and a base of said third transistors; a second capacitor coupled between said drain of said second transistor and said base of third transistor; a third capacitor coupled between said base of said third transistor and ground; a fourth resistor coupled between said positive voltage source and a collector of said third transistor; a fifth resistor coupled between said emitter of said third transistor and ground; and a fourth capacitor coupled between said collector of said third transistor and said output terminal.

* * * * *